US008668301B2

(12) United States Patent
Karasawa et al.

(10) Patent No.: US 8,668,301 B2
(45) Date of Patent: Mar. 11, 2014

(54) LIQUID DETECTION SYSTEM AND LIQUID CONTAINER

(75) Inventors: Masahiro Karasawa, Matsumoto (JP); Yuji Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 13/312,913

(22) Filed: Dec. 6, 2011

(65) Prior Publication Data

US 2012/0262515 A1 Oct. 18, 2012

(30) Foreign Application Priority Data

Dec. 8, 2010 (JP) ..... 2010-273266

(51) Int. Cl.
*B41J 29/393* (2006.01)

(52) U.S. Cl.
USPC ..... 347/19

(58) Field of Classification Search
CPC ..... B41J 2/17566; B41J 2/17583
USPC ..... 347/7, 19, 84–86
See application file for complete search history.

(56) References Cited

U.S. PATENT DOCUMENTS

| | | | |
|---|---|---|---|
| 7,422,316 | B2 | 9/2008 | Shinada |
| 7,731,344 | B2 | 6/2010 | Iwamuro et al. |
| 7,997,703 | B2 | 8/2011 | Naka et al. |
| 2007/0040859 | A1 | 2/2007 | Kimura |
| 2007/0243104 | A1 | 10/2007 | Aoki et al. |

FOREIGN PATENT DOCUMENTS

| | | | |
|---|---|---|---|
| JP | 08-011807 | A | 1/1996 |
| JP | 2005-022257 | A | 1/2005 |
| JP | 2006-035484 | A | 2/2006 |
| JP | 2007-076363 | A | 3/2007 |
| JP | 2007-307894 | A | 11/2007 |
| JP | 2008-037016 | A | 2/2008 |
| JP | 2009-119877 | A | 6/2009 |

*Primary Examiner* — An Do
(74) *Attorney, Agent, or Firm* — Kilpatrick Townsend & Stockton LLP

(57) ABSTRACT

A cavity is provided between a supply port which supplies the liquid which is received in the liquid reception unit to the outside and the liquid reception unit, with a variable portion which is deformed between the supply port and the liquid reception unit. The variable portion is urged using an urging member from the inside of the cavity through a pressure reception member. In addition, a change in a position of the pressure reception member can be detected using a detection unit. Further, a notch is provided at a surface where the pressure reception member comes into close contact with the urging member, in which the notch extends to the outside from the inside of the contact surface.

12 Claims, 6 Drawing Sheets

LIQUID DETECTION SYSTEM AND LIQUID CONTAINER

This application claims priority to Japanese Patent Application No. 2010-273266, filed Dec. 8, 2010, the entirety of which is incorporated by reference herein.

BACKGROUND

1. Technical Field

The present invention relates to a technology in which liquid in a liquid container which receives the liquid is detected.

2. Related Art

Similarly to a so-called ink jet printer, a liquid container such as an ink cartridge, inside of which ink is contained as an ink supply source, is mounted in a liquid ejecting apparatus which ejects liquid such as ink from an ejection nozzle. The liquid container is mounted so as to be replaced with respect to the liquid ejecting apparatus, and is able to be replaced to a new liquid container when the liquid in the liquid container is run out.

In addition, in order to inform a user when to replace the liquid container, a liquid container is provided which includes a liquid detection device for detecting that liquid in the container has run out, between a liquid reception unit which receives liquid and a supply port which supplies the received liquid to the outside of the liquid container. The liquid detection device is provided with a cavity which is formed of a concave portion and a film which covers the concave portion, and the inside thereof is filled with the liquid from the liquid reception unit. In addition, a pressure reception plate and a spring are provided in the inside of the cavity, and the spring urges the film to one side through the pressure reception plate. In such a liquid detection device, when the liquid remains in the liquid reception unit, the pressure of the liquid and the pressure from the spring are applied to the film which covers the concave portion, since the liquid is supplied to the cavity. However, when the liquid in the liquid reception unit runs out, the pressure of the liquid is not applied to the film, and the position of the film (and the pressure reception plate) moves, since the liquid is not supplied to the cavity. A technology is proposed in JP-A-2007-307894, in which the fact that the liquid in the liquid reception unit has run out is detected, by detecting the change in the position of the pressure reception plate at this time.

However, in the above described related art, there was a problem in that bubbles accumulated at the rear side portion of the pressure reception plate where the pressure reception plate came into close contact with the spring. As a result, there was a problem in that it was not easy to appropriately detect that the liquid in the liquid reception unit had run out, since bubbles remained in the cavity.

SUMMARY

An advantage of some aspect of the invention, there is provided a technology in which bubbles are prevented from accumulating in a portion in which the pressure reception plate and the spring in the cavity come into close contact with each other.

According to an aspect of the invention, there is provided a liquid detection system according to some aspects of the invention adopts the following configuration. That is, the liquid detection system which detects the presence and non-presence of liquid in a liquid reception unit which receives the liquid includes, a cavity which is provided between a supply port which supplies the liquid which is received in the liquid reception unit to the outside and the liquid reception unit, the inside of which is filled with the liquid from the liquid reception unit, and at least a part of which is provided with a variable portion which can deform; a pressure reception member which is provided in the inside of the cavity; an urging member which urges the variable portion from the inside of the cavity through the pressure reception member; and a detection unit which detects a change in a position of the pressure reception member which is caused to come into contact with the variable portion, using the urging member, wherein it is the point that the pressure reception member is provided with a notch at a surface where the pressure reception member comes into close contact with the urging member, in which the notch extends to the outside of a contact surface from the inside of the contact surface.

In such a liquid detection system according to the aspect of the invention, since the liquid is supplied to the cavity when the liquid remains in the liquid reception unit, a pressure of the liquid and a pressure from the urging member are applied to the variable portion of the cavity. On the other hand, since the liquid is not supplied to the cavity when the liquid runs out in the liquid reception unit, the pressure in the cavity is lowered, and the position of the variable portion (and the pressure reception member) is moved. In addition, it is possible for the detection unit to detect the change in the position of the pressure reception member. Further, in the pressure reception member of the liquid detection system according to the aspect of the invention, the notch is provided, which extends from the inside to the outside of a surface where the pressure reception member comes into close contact with the urging member.

In this manner, it is possible to detect whether or not liquid remains in the liquid reception unit, by detecting the change in the position of the pressure reception member. In addition, since the notch is provided at the surface where the pressure reception member comes into close contact with the urging member, which extends from the inside to the outside of the contact surface, it is possible to make bubbles go off to the outside of the contact surface, even when the bubbles are accumulated at a position where the pressure reception member comes into close contact with the urging member. Accordingly, since it is possible to effectively prevent the bubbles from remaining in the cavity, the bubbles in the cavity can be prevented from hindering the pressure of the liquid reaching the variable portion of the cavity. As a result, it is possible to appropriately detect that the liquid in the liquid reception unit has run out.

In addition, in the liquid detection system according to the aspect of the invention, the notch may be formed in approximately the same direction as the direction where the liquid in the cavity flows along the surface where the pressure reception member comes into close contact with the urging member.

In this manner, the liquid in the cavity passes through the notch of the pressure reception member along the surface where the pressure reception member comes into close contact with the urging member, and slips off to the outside of the pressure reception member. Since the bubbles which accumulate at the contact surface of the pressure reception member and the urging member are discharged to the outside of the contact surface due to such a flow of the liquid, it is possible to further effectively prevent the bubbles from accumulating at the contact surface of the pressure reception member and the urging member. As a result, it is possible to appropriately detect that the liquid in the liquid reception unit has run out.

According to another aspect of the invention, there is provided a liquid detection system, that is, a liquid container which supplies liquid to the outside including, a liquid reception unit which receives the liquid inside; a supply port which supplies the liquid received in the liquid reception unit to the outside; a cavity which is provided between the liquid reception unit and the supply port, the inside of which is filled with the liquid from the liquid reception unit, and at least a part of which is provided with a variable portion which can deform; a pressure reception member which is provided inside the cavity; and an urging member which urges the variable portion from the inside of the cavity through the pressure reception member, wherein it is the point that the pressure reception member is provided with a notch at a surface where the pressure reception member comes into close contact with the urging member, in which the notch extends to the outside of the contact surface from the center of the contact surface.

In such a liquid container according to the aspect of the invention, when the liquid in the liquid reception unit runs out, the pressure in the cavity is lowered, and the positions of the variable portion and the pressure reception member move, since the liquid is not supplied to the cavity from the liquid reception unit. Accordingly, for example, it is possible to detect whether or not liquid remains in the liquid reception unit, by detecting the change in the position of the pressure reception member at the outside of the liquid container. In addition, it is possible to allow the bubbles to escape, which accumulate at the contact portion, since the notch is provided at the contact surface of the pressure reception member and the urging member, which extends from the inside to the outside of the contact surface. As a result, it is possible to effectively prevent the bubbles from remaining in the cavity, and to appropriately detect that the liquid in the liquid container has run out.

In addition, in the above described liquid container according to the aspect of the invention, the detection unit which detects the change in the position of the pressure reception member which comes into close contact with the variable portion of the cavity may be provided inside the liquid container. In this manner, it is possible to detect the presence and non-presence of the liquid in the liquid container, without providing a configuration for detecting the change in the position of the pressure reception member at the outside of the liquid container.

In addition, in the above described liquid container according to the aspect of the invention, the notch of the pressure reception member may be provided in approximately the same direction as the direction where the liquid in the cavity flows along the surface where the pressure reception member comes into close contact with the urging member.

In this manner, the liquid in the cavity passes through the notch of the pressure reception member along the surface where the pressure reception member comes into close contact with the urging member, and slips off to the outside of the pressure reception member. Accordingly, since the bubbles which accumulate at the contact surface of the pressure reception member and the urging member are discharged to the outside of the contact surface due to the flow of the liquid, it is possible to further effectively prevent the bubbles from accumulating inside the cavity. As a result, it is possible to appropriately detect that the liquid in the liquid container has run out.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described in the following order, in order to make the above described contents of the application of the invention clear.

A. Configuration of device:

B. Structure of ink detection device of embodiments:

C. Modified example:

A. Configuration of Device

Figure 1:
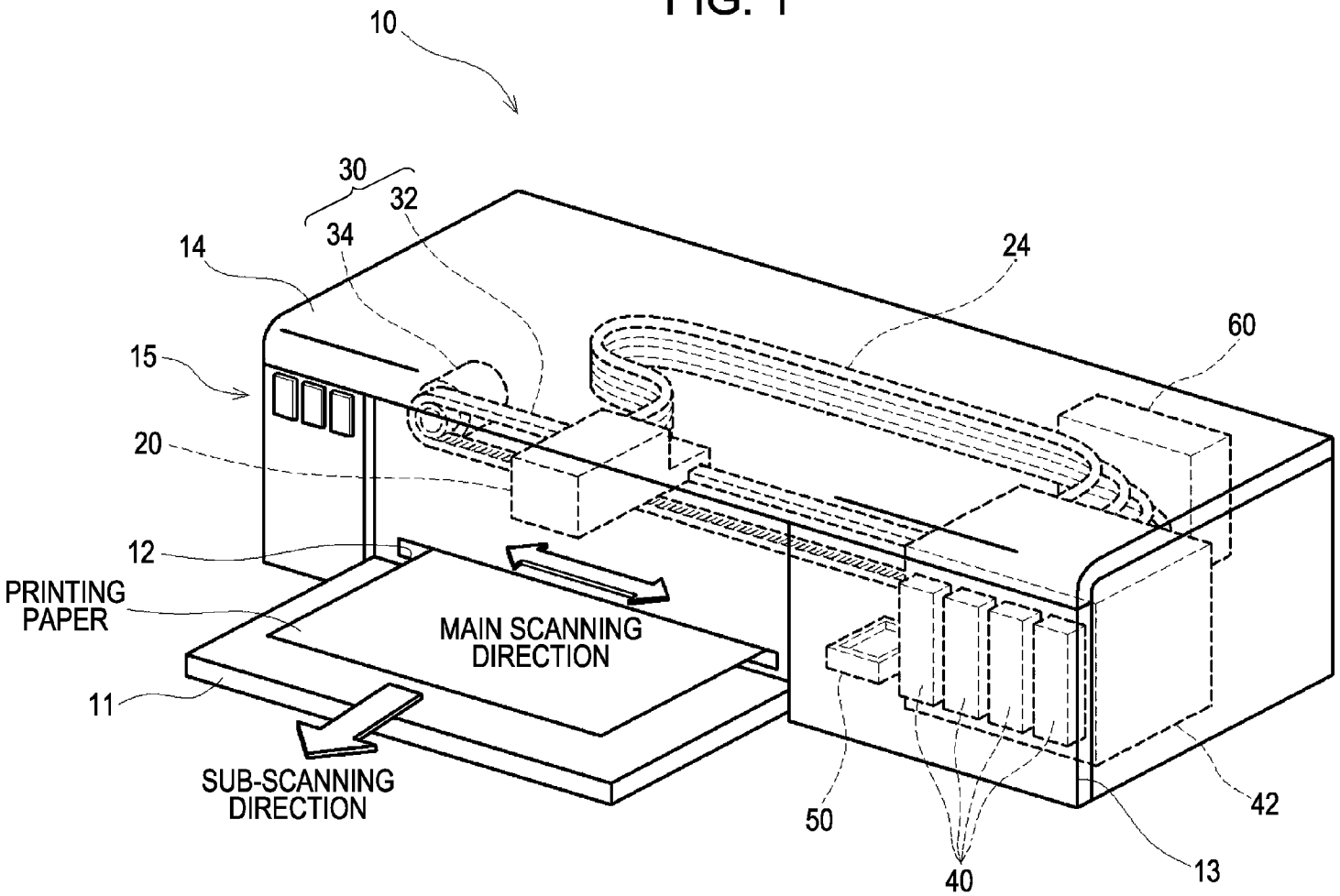
FIG. 1 is an explanatory diagram which exemplifies a configuration of an ink jet printer.

FIG. 1 is an explanatory diagram which shows a rough configuration of a liquid ejecting apparatus according to the embodiment of the invention in which a so-called ink jet printer is used as an example. The exemplified ink jet printer 10 has an appearance of approximately a box shape, a front cover 11 is provided at substantially the center of the front surface thereof, and a plurality of operation buttons 15 are provided on the immediate left side thereof. The front cover 11 is axially supported at the lower end, and when the upped end is pulled down to the front, a thin and long sheet discharge port 12 which discharges printing paper appears. In addition, a sheet feeding tray (not shown) is provided at the rear surface side of the ink jet printer 10. The ink jet printer 10 has a configuration in which the printing paper is fed from the sheet feeding tray, an image or the like is printed on the surface of the printing paper in the inside, and then the printing paper is discharged from the sheet discharge port 12, when the printing paper is set in the sheet feeding tray, and the operation buttons 15 are operated.

In addition, an upper cover 14 is provided on the upper surface side of the ink jet printer 10. The upper cover 14 is axially supported at the depth side. It is possible to check the state inside the ink jet printer 10, or to make repairs on the ink jet printer 10, when opening the upper cover 14 by lifting the front side.

In addition, an ejection head 20 which forms ink dots on the printing paper while reciprocating in the main scanning direction, a driving mechanism 30 which allows the ejection head 20 to reciprocate, or the like, is mounted inside the ink jet printer 10. A plurality of ejection nozzles are provided at the bottom side of the ejection head 20 (a side which faces the printing paper), and ink is ejected toward the printing paper from the ejection nozzles.

In addition, the ink ejected from the ejection nozzles is received in a dedicated container which is called an ink cartridge 40. The ink cartridge 40 is loaded to a cartridge holder 42 which is provided at a different position from the ejection head 20. The ink in the ink cartridge 40 is supplied to the ejection head 20 through an ink tube 24. In the ink jet printer 10 according to the embodiment, a cover 13 for replacing cartridge, which is axially supported at the lower end side, is provided on the immediate right side of the front cover 11. The ink cartridge 40 is detachably provided, by pulling down the upper end side of the cover 13 for replacing cartridge to the front side.

In addition, in the shown ink jet printer 10, it is possible to print a color image using four colors of ink of cyan, magenta, yellow, and black. To correspond to this, ejection nozzles are provided for each color of ink in the ejection head 20. Further, the ink in the ink cartridge 40 corresponding to each of the ejection nozzles is supplied through the ink tube 24 which is provided for each color of ink, in each of the ejection nozzles.

The driving mechanism 30 which allows the ejection head 20 to reciprocate is configured by a timing belt 32 of which the inside is formed of a plurality of tooth, a driving motor 34 for driving the timing belt 32, and the like. A part of the timing belt 32 is fixed to the ejection head 20. When the timing belt 32 is driven, it is possible to make the ejection head 20 reciprocate in the main scanning direction while guiding the ejection head 20 using a guide rail (not shown) which is extended in the main scanning direction.

In addition, a region which is called a home position is provided at a position other than a printing region in which the ejection head 20 is moved in the main scanning direction, and a maintenance mechanism is mounted at the home position. The maintenance mechanism is pressed to a surface (nozzle surface) where the ejection nozzle is formed on the bottom side (a side facing the printing paper) of the ejection head 20, and is configured by a cap 50 which forms a closed space so as to surround the ejection nozzle, a lifting mechanism (not shown) for lifting the cap 50 in order to press the cap to the nozzle surface of the ejection head 20, a suction pump (not shown) which introduces a negative pressure to the closed space which is formed by pressing the cap 50 to the nozzle surface of the ejection head 20, or the like.

In addition, sheet sending mechanism (not shown) which sends the printing paper, a control unit 60 which controls the entire operation of the ink jet printer 10, or the like, is also mounted in the ink jet printer 10. An operation which makes the ejection head 20 reciprocate, an operation which sends the printing paper, an operation which ejects ink from the ejection nozzle, an operation which performs the maintenance in order to perform normal printing, or the like are entirely controlled by the control unit 60.

Figure 2:
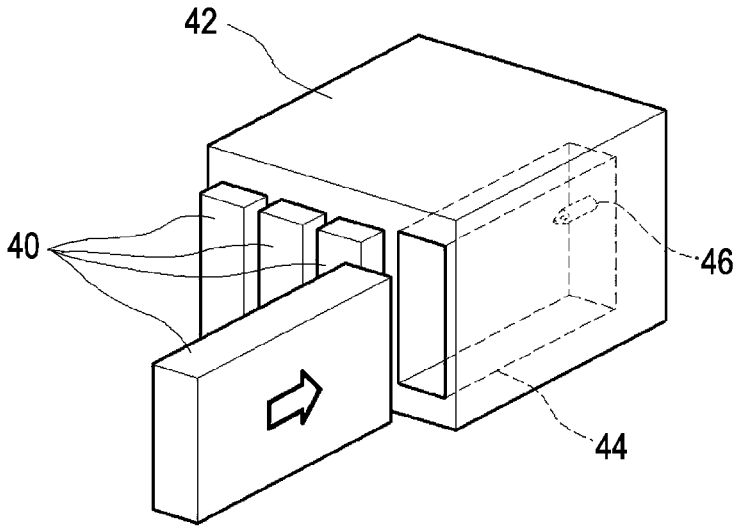
FIG. 2 is an explanatory diagram in which an ink cartridge is loaded to a cartridge holder.

FIG. 2 is an explanatory diagram which shows a state where the ink cartridge 40 is installed to the cartridge holder 42. As shown in the drawing, an insertion hole 44, to which the ink cartridge 40 is inserted from the front side to the depth side, is provided for each ink cartridge 40, in the cartridge holder 42. An ink intake needle 46 which takes in the ink from the ink cartridge 40 is provided toward the front side, on the surface of the depth side of the insertion hole 44. In addition, an ink supply port (not shown) is provided at the rear surface of the ink cartridge 40. When the ink cartridge 40 is inserted and installed deep into the insertion hole 44 of the cartridge holder 42, the ink intake needle 46 is inserted into the ink supply port, and it is possible to take in the ink in the ink cartridge 40 to the cartridge holder 42.

In addition, an ink path (not shown) or a diaphragm pump is embedded in the cartridge holder 42, and the ink which is taken in from the ink intake needle 46 is guided to the ink tube 24 (refer to FIG. 1) which is connected to the rear side surface of the cartridge holder 42, by the ink path. Further, the diaphragm pump which is provided in the ink path is presumed to perform suction of the ink in the ink cartridge 40, and transfers the ink toward the ejection head 20 in a pressing manner. In addition, as described above, in the ink jet printer 10 according to the embodiment, the ink cartridges 40 of four colors of ink of cyan, magenta, yellow, and black are mounted. The ink in the ink cartridges 40 is respectively and independently supplied to the ejection head 20. For this reason, the ink path and the diaphragm pump are provided for each of the ink cartridges 40, in the cartridge holder 42.

Figure 3:
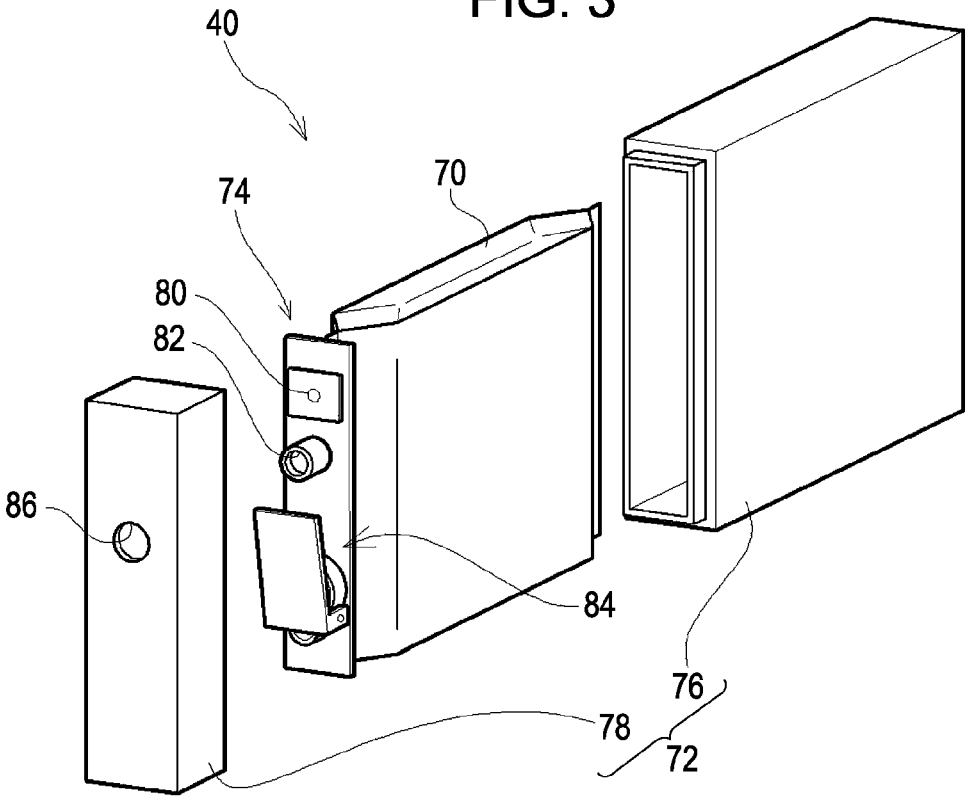
FIG. 3 is an exploded perspective view which shows a configuration of the ink cartridge.

FIG. 3 is an exploded perspective view which shows a configuration of the ink cartridges 40 according to the embodiment of the invention. As shown in the drawing, the ink cartridge 40 is configured by an ink pack 70 which receives the ink, a cartridge case 72 which receives the ink pack 70, an ink supply unit 74 which is provided at an edge portion on the front side of the ink pack 70, and the like. In the ink supply unit 74, an inlet 80 for filling up the ink in the ink pack 70 at a manufacturing stage of the ink cartridge 40, the ink supply port 82 for supplying the ink in the ink pack 70 toward the ejection head 20, an ink detection device 84 for detecting the presence or non-presence of the ink in the ink pack 70, or the like are provided. The detailed structure of the ink detection device 84 will be described later.

The cartridge case 72 which receives the ink pack 70 is configured by a main body case 76 and a lid portion 78. The main body case 76 which is formed of a box shape can receive the ink pack 70 in the inside. On the other hand the lid portion 78 is a member which closes an opening portion (put a lid on) of the main body case 76. Such a main body case 76 and a lid portion 78 are bonded when the lid portion 78 is fitted into the opening portion of the main body case 76. In addition, a supply port hole 86 which allows the ink supply port 82 of the ink pack 70 to go off to the outside of the lid portion 78 is provided in the lid portion 78. When the opening portion of the main body case 76 is closed using the lid portion 78, the ink supply port 82 is fixed to the position of the supply port hole 86.

B. Structure of Ink Detection Device in the Embodiment

Figure 4:
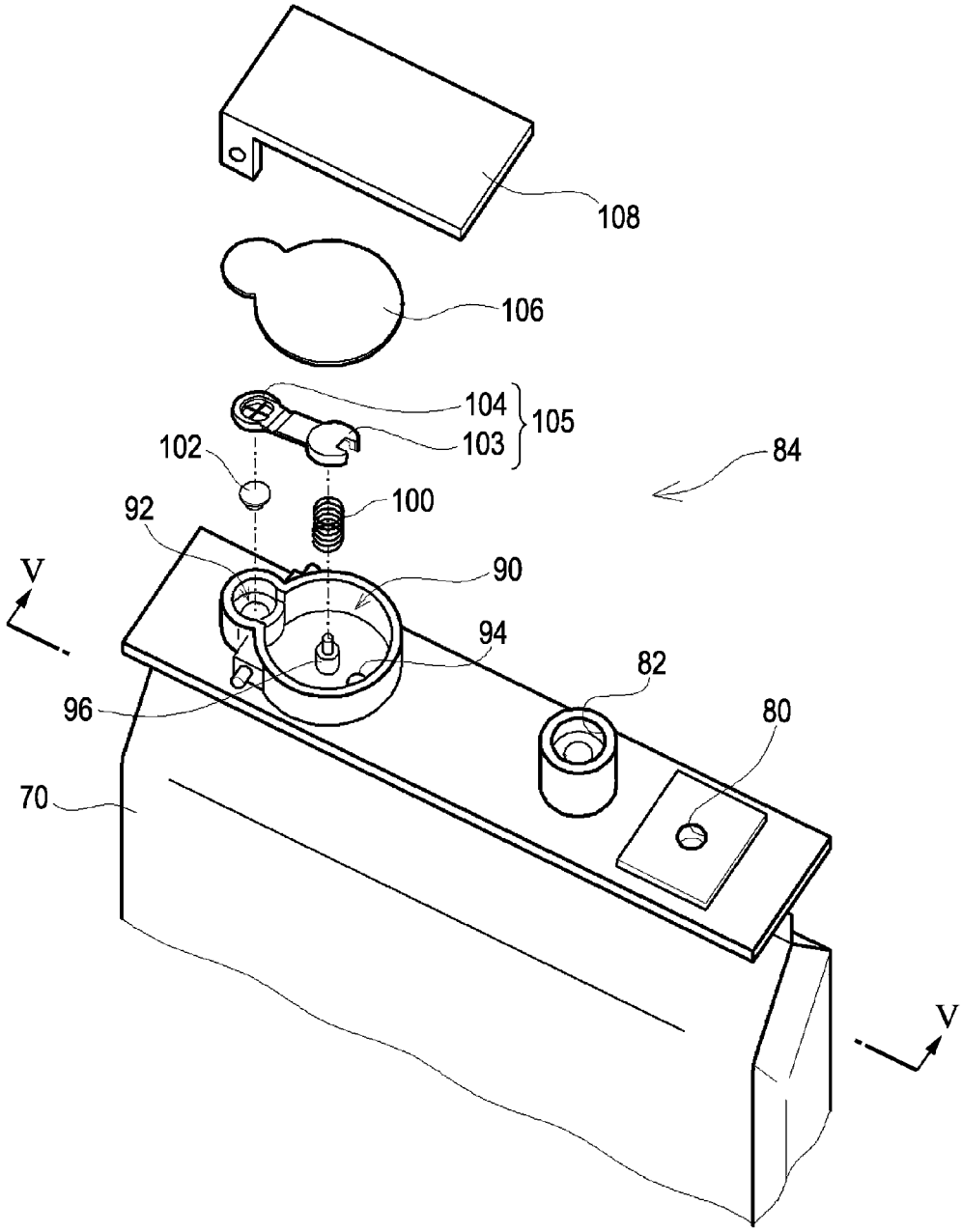
FIG. 4 is an exploded perspective view which shows a detailed structure of an ink detection device according to the embodiment of the invention.

FIG. 4 is an exploded perspective view which shows a detailed structure of the ink detection device 84 which is mounted onto the ink cartridge 40 according to the embodiment of the invention. In addition, FIG. 4 shows a state where the ink detection device 84 is seen from the above of the ink pack 70, in a state where the ink supply port 82 faces vertically upward.

As shown in the drawing, the ink detection device 84 according to the embodiment is roughly configured by a cavity 90 of an approximately disk shape of which the inside is filled with the ink from the ink pack 70, various components which are received in the cavity 90, a film 106 which seals the opening portion of the cavity 90 in a state where these components are received in the cavity 90, a lever 108 which is attached to the cavity 90 of which the opening portion is sealed with the film 106, or the like. In addition, the cavity 90 in the embodiment corresponds to the "cavity" of this application, and the film 106 which seals the opening portion of the cavity 90 corresponds to the "variable portion" of the cavity of the application.

In the ink cartridge 40 according to the embodiment, which will be described in detail later, the ink in the ink pack 70 is presumed to pass through the cavity 90, while the ink in the ink pack 70 flows out to the outside from the ink supply port 82 through an internal path (not shown). Along with this, an inlet 92 which allows the ink from the ink pack 70 to flow in, and an outlet 94 which allows the ink to flow out to the ink supply port 82 are provided in the cavity 90.

In addition, a check valve 102 for preventing the ink from flowing backward to the ink pack 70 from the cavity 90 and an urging spring 100 (urging member) for urging the film 106 from the inside of the cavity 90 are provided inside the cavity 90. A pressure reception plate 105 (pressure reception member) is provided between the check valve 102 and the urging spring 100, and the film 106.

A movement regulation unit 104 which regulates the movement of the check valve 102 to the upstream side of the inlet 92, while allowing the ink to flow into the cavity 90 from the inlet 92, and a spring reception unit 103 which inserts the urging spring 100 between the spring reception portion and a convex portion 96 which is erected upward from the bottom of the cavity 90, or the like, are provided in the pressure reception plate 105. In addition, the movement regulation unit 104 and the spring reception unit 103 are connected to each other and are integrally formed as one member, however, the movement regulation unit 104 and the spring reception unit 103 may be separated from each other, and may be configured as an individual member. In addition, the spring reception unit 103 of the pressure reception plate 105 according to the embodiment is an approximately disk shaped member of which a surface which comes into close contact with the urging spring 100 is formed of a concave shape. A part of the member is notched toward the outside from the vicinity of the center portion of the disk. The reason why such a notch is provided in the spring reception unit 103 will be described later.

When the movement regulation unit 104 of the pressure reception plate 105 as described above is fitted into the inlet 92 of the cavity 90, the check valve 102 is isolated to the downstream side of the inlet 92, and the movement thereof to the upstream side is regulated, and one end (an end portion on the side which is not fixed to the convex portion 96) of the urging spring 100 is fixed to the concave portion of the rear surface of the spring reception unit 103, and the urging spring 100 is positioned at a predetermined position of the cavity 90.

In addition, a lever 108 is provided at the upper part of the cavity 90 which is shut using the film 106, and the lever 108 is rotatably supported around the position of an attaching hole, by fitting the attaching hole which is provided at one end of the lever 108 into a protrusion which is provided at the outer surface of the cavity 90. In the ink detection device 84 according to the embodiment which is configured as described above, the fact that the ink in the ink pack 70 has run out is detected as follows.

Figure 5A:
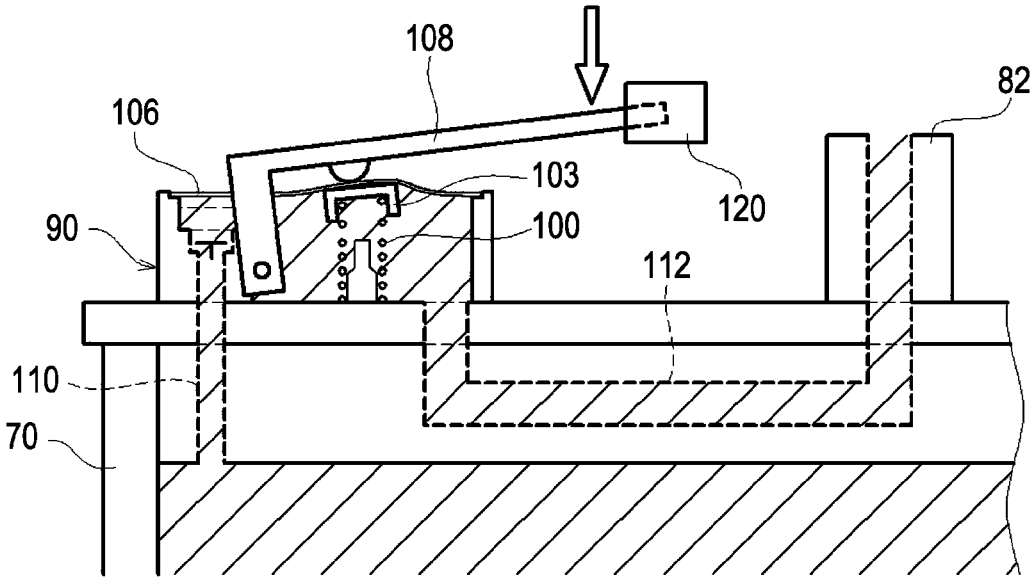
FIGS. 5A and 5B are explanatory diagrams which show a method of detecting that ink in an ink pack has run out, using the ink detection device.
Figure 5B:
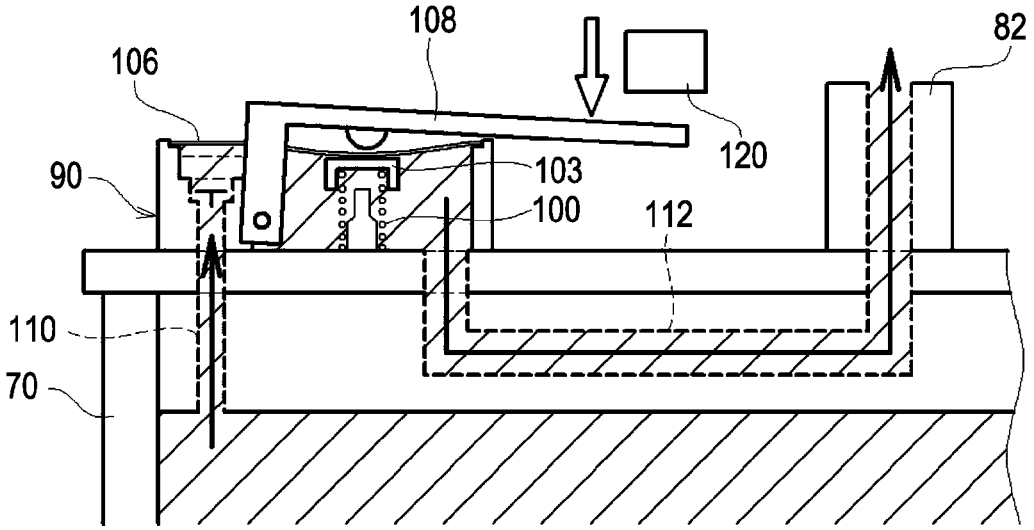

FIGS. 5A and 5B are explanatory diagrams which show a mechanism in which the ink detection device 84 detects that the ink in the ink pack 70 has run out. In FIGS. 5A and 5B, a cross-section in which the line V-V which passes through the center of the cavity 90 in a state shown in FIG. 4 is taken, and the cross-section is shown from the front side of the ink pack 70. In addition, in FIG. 5A, the ink detection device 84 is in a state where the ink is not sucked out from the ink supply port 82. In FIG. 5B, the ink detection device 84 is in a state where the ink is sucked out from the ink supply port 82.

As shown in FIG. 5A, in the state where the ink is not sucked out from the ink supply port 82, the spring reception unit 103 is urged in the direction of the film 106 by the urging spring 100 in the cavity 90, and thus a portion of the film 106 which comes into close contact with the spring reception unit 103 deforms, and a force to push the lever 108 out to the upper part is applied.

In addition, from the front surface side of the lever 108 (an opposite side to a surface which faces the cavity 90), a force to push back the lever 108 is applied to the lever 108 due to an urging mechanism which is not shown. In the figure, the direction of the force which is applied to the lever 108 due to the urging mechanism is shown using an arrow. In addition, when these forces in the opposite direction which are applied to the lever 108 are balanced, as shown in FIG. 5A, the lever 108 is maintained to a state where the lever 108 is slightly pushed out.

In addition, in the ink cartridge 40 according to the embodiment, the diameter of an internal path 112 which connects the cavity 90 and the ink supply port 82 is larger than the diameter of an internal path 110 which connects the cavity 90 and the ink pack 70. For this reason, when the ink is sucked out from the ink supply port 82 which is to supply the ink to the ejection head 20, the inside of the cavity 90 becomes the negative pressure. At this time, as shown in FIG. 5B, the film 106 deforms toward the inside of the cavity 90 due to the negative pressure. As a result, the lever 108 is pushed down due to the urging mechanism which is not shown.

Here, if the ink remains in the ink pack 70, the pressure in the cavity 90 returns to its original state when ink is supplied late into the cavity 90. For this reason, if a certain period of time passes after sucking the ink from the ink supply port 82, the lever 108 is pushed out again due to the spring reception unit 103 when the film 106 returns to the original state (the state shown in FIG. 5A). Accordingly, when the lever 108 is detected using a photo sensor 120 which is provided at a front end portion of the lever 108, after a certain period of time has passed after sucking the ink, it is determined that the ink still remains in the ink pack 70.

In addition, in the embodiment, it is described that the photo sensor 120 which detects the lever 108 is provided in the ink cartridge 40, however, the photo sensor 120 may be provided to the outside of the ink cartridge 40 (for example, in the cartridge holder 42). In this case, for example, it may be possible to provide a mechanism (transfer mechanism) for transferring the motion of the lever 108 to the outside of the ink cartridge 40, and to detect the change in the position of the lever 108, using the photo sensor 120 on the cartridge holder 42 side through the transfer mechanism.

On the other hand, when the ink in the ink pack 70 has run out, the lever 108 remains in a state of being pushed down due to the urging mechanism (not shown), since the amount of ink which has flown out from the cavity 90 is not supplied to the cavity 90. Accordingly, since the lever 108 is not detected by the photo sensor 120 even if a certain period of time has passed after the ink is sucked out from the ink supply port 82, in this case, it is determined that the ink in the ink pack 70 has run out. As described above, in the ink detection device 84 according to the embodiment, it is possible to detect that the ink in the ink pack 70 has run out, by detecting the change in pressure in the cavity 90 as the change in the position of the spring reception unit 103 (and a change in the position of the lever 108 accompanying to this).

In addition, the photo sensor 120 according to the embodiment corresponds to the "detection unit" of this application, since the photo sensor detects the change in the position of the spring reception unit 103 (pressure reception member) of the pressure reception plate 105 which comes into close contact with the film 106 (variable portion) through the lever 108.

Here, as described above, the inside of the cavity 90 of the ink detection device 84 according to the embodiment is an extremely narrow space. For this reason, there is a case where bubbles are mixed in the cavity 90 when filling up the ink for the first time in the cavity 90 (during initial filling). Especially, since the shape of the spring reception unit 103 has a concave shape at a position where the urging spring 100 comes into close contact with the spring reception unit 103 (refer to FIG. 4), if bubbles are mixed into the concave portion, the bubbles are not easily removed, and remain in the cavity 90. In addition, as described above, in the ink detection device 84 according to the embodiment, since the presence and non-presence of the ink in the ink pack 70 is detected by detecting the change in pressure in the cavity 90 (refer to FIGS. 5A and 5B), it is difficult to appropriately detect the presence and non-presence of the ink in the ink pack 70, in a state where the bubbles are remained in the cavity 90.

Therefore, as described above, in the ink detection device 84 according to the embodiment, the bubbles are prevented from remaining at the position where the urging spring 100 comes into close contact with the spring reception unit 103, by allowing a notch portion at a part of a member of the spring reception unit 103 of the pressure reception plate 105 in the cavity 90 (refer to FIG. 4). Hereinafter, the fact will be described.

Figure 6A:
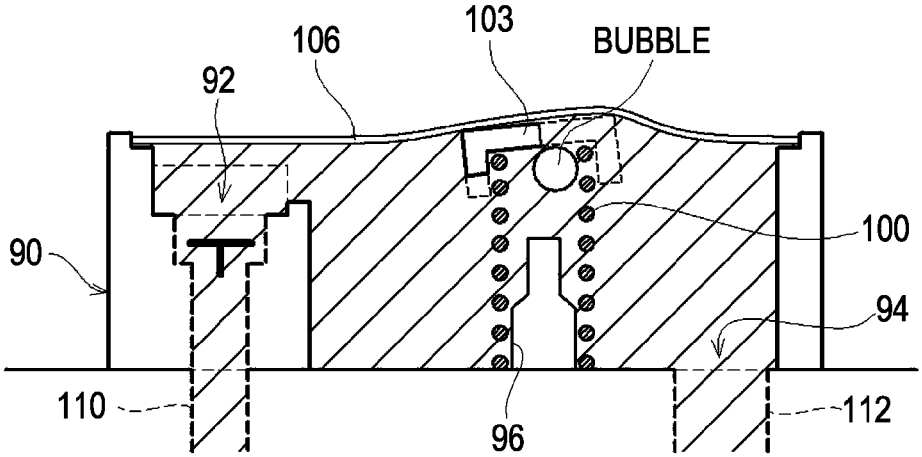
FIGS. 6A and 6B are explanatory diagrams which show a reason why bubbles are prevented from accumulating at a surface where a spring reception portion comes into close contact with an urging spring, in the ink detection device according to the embodiment.
Figure 6B:
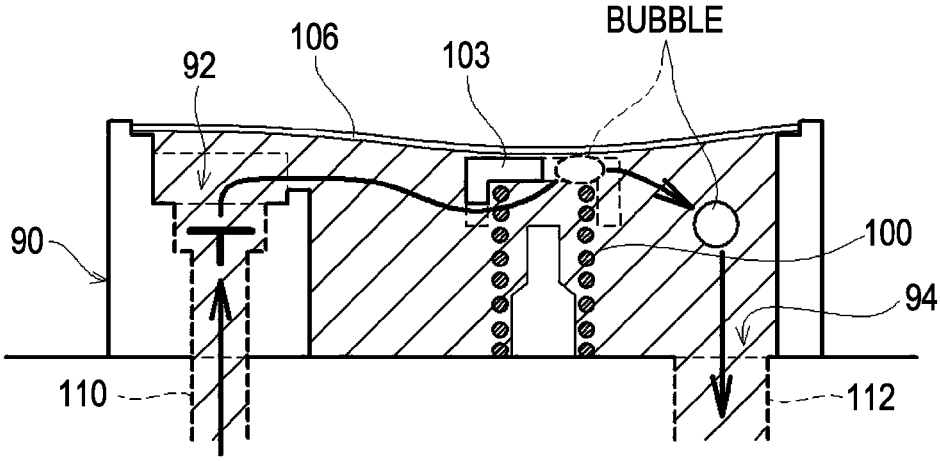

FIGS. 6A and 6B are explanatory diagrams showing how the bubbles are prevented from accumulating at a position where the spring reception unit 103 comes into close contact with the urging spring 100. In addition, in FIGS. 6A and 6B, enlarged vertical cross-sections of the cavity 90, which are shown in FIGS. 5A and 5B, are illustrated.

As described above, the spring reception unit 103 according to the embodiment is a disk-shaped member of which the contact surface with the urging spring 100 is formed in a concave shape, and a part of the member is notched from the inside to the outside of the disk (refer to FIG. 4). For this reason, as shown in FIG. 6A, a path with a depth corresponding to the thickness of the spring reception unit 103 is formed toward the outside from the inside of the contact surface of the spring reception unit 103 and the urging spring 100.

In addition, the direction of the notch in the spring reception unit 103 is approximately the same direction as the direction where the ink flows from the inlet 92 to the outlet 94 of the cavity 90. Further, this direction is also the direction where the lever 108 which is attached to the cavity 90 goes toward the front end from the base portion (the direction from the movement regulation unit 104 of the pressure reception plate 105 to the spring reception unit 103). For this reason, as shown in FIG. 6B, a part of the ink which flows from the inlet 92 to the outlet 94 passes through the notch portion of the spring reception unit 103 along the surface where the spring reception unit 103 comes into close contact with the urging spring 100, goes out to the outside of the spring reception unit 103, and moves to the outlet 94. As a result, the bubbles which accumulate at the surface where the spring reception unit 103 comes into close contact with the urging spring 100 are discharged to the outside of the spring reception unit 103, and are further discharged to the upstream side of the cavity 90 from the outlet 94.

In the ink detection device 84 according to the embodiment including the spring reception unit 103 which is formed as described above, it is possible for the bubbles which are accumulated at the contact portion of the spring reception unit 103 and the urging spring 100 to go off to the outside of the spring reception unit 103. Accordingly, since the bubbles can be prevented from accumulating in the cavity 90, it is possible to suppress the influences of the change in pressure in the cavity 90 due to the bubbles. As a result, it is possible to appropriately detect that the ink in the ink pack 70 has run out, when the spring reception unit 103 moves due to the fact that the change in pressure in the cavity 90 is appropriately reflected.

In addition, as described above, the spring reception unit 103 is notched in approximately the same direction as the direction where the ink in the cavity 90 flows (refer to FIGS. 6A and 6B). Accordingly, it is possible to prevent the flow of ink in the cavity 90 from congesting at the position of the spring reception unit 103. As a result, it is possible to reduce a load of a pump (a diaphragm pump in the embodiment) which sucks out the ink on the cartridge holder 42 side from the ink supply port 82, since it is possible to suck out the ink easily from the ink cartridge 40.

Further, if the notch is provided in the spring reception unit 103, it is possible to check whether the urging spring 100 is attached to the spring reception unit 103 in a state where the pressure reception plate 105 is attached to the cavity 90, when assembling the ink detection device 84, in the manufacturing stage of the ink cartridge 40. Accordingly, when attaching of the urging spring 100 is accidentally missed by mistake, it is possible for the manufacturer to find out the fact easily. Therefore, it is possible to suppress the generation of defective goods of the ink cartridge 40.

C. Modified Example

Figure 8:
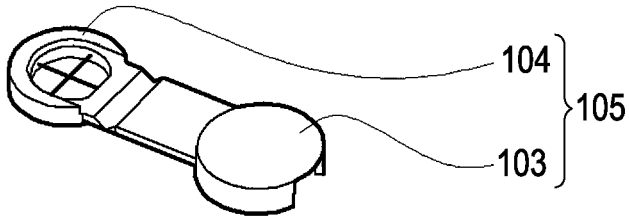
FIG. 8 is an explanatory diagram which shows a pressure reception plate according to the modified example.

In the above described ink detection device 84 of the ink cartridge 40 according to the embodiment, when notching the spring reception unit 103, it was described that the notch reached the upper surface member (a surface on the side where the spring reception unit 103 comes into close contact with the film 106) of the spring reception unit 103. However, since the notch of the spring reception unit 103 may form a gap through which the bubbles can pass, it is not necessarily formed to the upper surface member of the spring reception unit 103. For example, as shown in FIG. 8, the notch may be provided from the upper surface of the spring reception unit 103 only to the erecting side surface (side wall).

Figure 7:
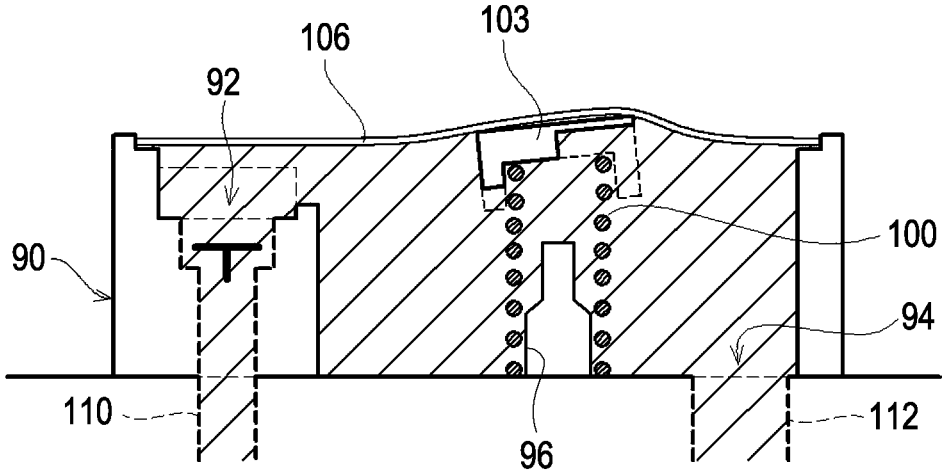
FIG. 7 is an explanatory diagram which shows a structure of the ink detection device according to a modified example.

FIG. 7 is an explanatory diagram which shows the inside of an ink detection device 84 in the modified example. In addition, in the modified example to be described in below, the same constituent portions as those of the embodiment described above, the same reference numerals as those of the embodiment will be given, and the detailed description will be omitted. As shown in the drawing, the ink detection device 84 in the modified example, the thickness of a spring reception unit 103 is formed to be thicker than that of the spring reception unit 103 shown in FIGS. 6A and 6B. In addition, a notch with the same depth as that of the spring reception unit 103 shown in FIGS. 6A and 6B is provided at the same position as that of the spring reception unit 103 shown in FIGS. 6A and 6B.

As described above, a pressing force is applied to the upper surface of the spring reception unit 103 from the urging mechanism through a contact point 108*a* of the lever 108 (refer to FIGS. 5A and 5B). Accordingly, if the notch is provided to the spring reception unit 103 according to the above described method, it is possible to increase a durability of the spring reception unit 103 with respect to the pressing force from the contact point 108*a* of the lever 108, while securing the discharge property of the bubbles which accumulate at the contact surface of the spring reception unit 103 and urging spring 100.

Hitherto, various embodiments are described, however, the invention is not limited to all of the embodiments described above, and may be executed in various embodiments without departing from the spirit of the invention.

What is claimed is:

1. A liquid detection system which detects the presence and non-presence of liquid in a liquid reception unit which receives the liquid comprising:

a cavity which is provided between a supply port which supplies the liquid which is received in the liquid reception unit to the outside and the liquid reception unit, the inside of which is filled with the liquid from the liquid reception unit, and at least a part of which is provided with a variable portion which can deform;

a pressure reception member which is provided in the inside of the cavity;

an urging member which urges the variable portion from the inside of the cavity through the pressure reception member; and a detection unit which detects a change in a position of the pressure reception member which is caused to come into close contact with the variable portion due to the urging member, wherein the pressure reception member is provided with a notch at a surface where the pressure reception member comes into close contact with the urging member, in which the notch extends to the outside of a contact surface from the inside of the contact surface.

2. The liquid detection system according to claim 1, wherein the notch of the pressure reception member is provided in approximately the same direction as the direction where the liquid in the cavity flows along the surface where the pressure reception member comes into close contact with the urging member.

3. The liquid detection system according to claim 1, wherein the cavity and supply port are dimensioned and configured such that a gas located within the cavity is discharged in the direction of the supply port.

4. The liquid detection system according to claim 1, further comprising a lever coupled to the pressure reception member, wherein the detection unit detects a change in a position of the pressure reception member by detecting a change in a position of the lever.

5. A liquid container which supplies liquid to the outside comprising:

a liquid reception unit which receives the liquid inside;

a supply port which supplies the liquid received in the liquid reception unit to the outside;

a cavity which is provided between the liquid reception unit and the supply port, the inside of which is filled with the liquid from the liquid reception unit, and at least a part of which is provided with a variable portion which can deform;

a pressure reception member which is provided in the inside of the cavity; and an urging member which urges the variable portion from the inside of the cavity through the pressure reception member, wherein the pressure reception member is provided with a notch at a surface where the pressure reception member comes into close contact with the urging member, in which the notch extends to the outside of the contact surface from the center of the contact surface.

6. The liquid container according to claim 5, further comprising:

a detection unit which detects a change in a position of the pressure reception member which comes into close contact with the variable portion due to the urging member.

7. The liquid container according to claim 5, wherein the notch of the pressure reception member is provided in approximately the same direction as the direction where the liquid in the cavity flows along the surface where the pressure reception member comes into close contact with the urging member.

8. The liquid container according to claim 5, wherein the cavity and supply port are dimensioned and configured such that a gas located within the cavity is discharged in the direction of the supply port.

9. The liquid container according to claim 5, further comprising a lever coupled to the pressure reception member, wherein the detection unit detects a change in a position of the pressure reception member by detecting a change in a position of the lever.

10. A liquid detection system which detects the presence and non-presence of liquid in a liquid reception unit which receives the liquid comprising:

a cavity which is provided between a supply port which supplies the liquid which is received in the liquid reception unit to the outside and the liquid reception unit, the inside of which is filled with the liquid from the liquid reception unit, and at least a part of which is provided with a variable portion which can deform;

a pressure reception member which is provided in the inside of the cavity;

an urging member which urges the variable portion from the inside of the cavity through the pressure reception member; and a detection unit which detects a change in a position of the pressure reception member which is caused to come into contact with the variable portion due to the urging member, wherein the pressure reception member is provided with a notch at a side surface which is erected from a surface where the pressure reception member comes into close contact with the urging member.

11. The liquid detection system according to claim 10, wherein the cavity and supply port are dimensioned and configured such that a gas located within the cavity is discharged in the direction of the supply port.

12. The liquid detection system according to claim 10, further comprising a lever coupled to the pressure reception member, wherein the detection unit detects a change in a position of the pressure reception member by detecting a change in a position of the lever.

* * * * *